US007636532B2

(12) United States Patent
Yuge

(10) Patent No.: US 7,636,532 B2
(45) Date of Patent: Dec. 22, 2009

(54) CHARGING DEVICE CAPABLE OF SWITCHING AND EXECUTING CHARGING PROCESSING FOR PHOTOSENSITIVE SURFACE OF PHOTOSENSITIVE MEMBER AND COLLECTION PROCESSING FOR DEVELOPING AGENT REMAINING ON THE PHOTOSENSITIVE SURFACE

(75) Inventor: Keiji Yuge, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 518 days.

(21) Appl. No.: 11/491,683

(22) Filed: Jul. 24, 2006

(65) Prior Publication Data

US 2008/0019733 A1 Jan. 24, 2008

(51) Int. Cl.
*G03G 15/22* (2006.01)
*G03G 15/02* (2006.01)

(52) U.S. Cl. ..... 399/148; 399/175

(58) Field of Classification Search ..... 399/100, 399/148, 175, 176, 354, 356, 358, 359
See application file for complete search history.

(56) References Cited

U.S. PATENT DOCUMENTS

| | | | | |
|---|---|---|---|---|
| 5,003,354 | A * | 3/1991 | Takamiya et al. | 399/347 |
| 5,296,905 | A * | 3/1994 | Yousey et al. | 399/356 |
| 6,381,431 | B1 * | 4/2002 | Kinoshita et al. | 399/175 |
| 2006/0072943 | A1 * | 4/2006 | Suzuki et al. | 399/302 |

FOREIGN PATENT DOCUMENTS

| | | |
|---|---|---|
| JP | 2001-051480 | 2/2001 |

* cited by examiner

*Primary Examiner*—David M Gray
*Assistant Examiner*—Billy J Lactaoen
(74) *Attorney, Agent, or Firm*—Turocy & Watson, LLP

(57) ABSTRACT

A charging device that switches and executes a first mode which brings a magnetic brush into contact with a photosensitive member to charge a surface of the photosensitive member and a second mode which collects a two-component developing agent including a toner and a carrier, which remains on the surface of the photosensitive member. The charging device includes a magnetic brush carrying roller, a toner collecting roller, a toner removing member, and a regulating member. The toner collecting roller is located further on a downstream side than the regulating member and further on an upstream side than a contact position of the magnetic brush and the photosensitive member in a moving direction of a roller surface of the magnetic brush carrying roller.

17 Claims, 3 Drawing Sheets

CHARGING DEVICE CAPABLE OF SWITCHING AND EXECUTING CHARGING PROCESSING FOR PHOTOSENSITIVE SURFACE OF PHOTOSENSITIVE MEMBER AND COLLECTION PROCESSING FOR DEVELOPING AGENT REMAINING ON THE PHOTOSENSITIVE SURFACE

BACKGROUND OF THE INVENTION

1. Field of the Invention

The present invention relates to a developing agent recycling technique in a charging device capable of switching and executing charging processing for a photosensitive surface of a photosensitive member and collection processing for a developing agent remaining on the photosensitive surface.

2. Description of the Related Art

An image forming apparatus such as a so-called electrophotographic apparatus or an electrostatic printer performs, after forming an electrostatic latent image on a photosensitive member, image formation processing by electrostatically depositing a developing agent on the electrostatic latent image and transferring a developing agent image onto a sheet. Since the electrostatic latent image and the developing agent not fully transferred remain on the photosensitive member after the transfer, the image forming apparatus removes this remaining developing agent with a cleaning device and subsequently removes the electrostatic latent image with a charge eliminating device. According to U.S. Pat. No. 5,051,332, there is disclosed a technique for reducing a size of an apparatus using a cleanerless developing device that simultaneously performs, when an electrostatic latent image on a photosensitive member passes the cleanerless developing device, development of the electrostatic latent image and cleaning of a developing agent remaining after the last transfer.

According to JP-A-4-86883, there is disclosed a technique for providing, in a cleanerless system for not bringing a cleaning blade into contact with a photosensitive member, a member such as a brush for nonpatternizing a transfer residual toner and applying an AC bias in a mode for discharging a toner accumulated at least on the member to realize prevention of soil in an image forming apparatus.

In a magnetic brush charging system, as in the technique described above, a transfer residual toner is caused to adhere to a magnetic brush related to charging processing while the transfer residual toner is nonpatternized. Thus, it is necessary to execute a mode for discharging a toner at the time of nonprinting. In particular, in printing with a high printing ratio and continuous printing, uniformity of charging may be spoiled by adhesion of the transfer residual toner before the mode for discharging a toner is executed.

In the conventional cleanerless system, the nonpatternized transfer residual toner is returned to a developing device in a state in which the transfer residual toner is caused to adhere to the photosensitive member. Thus, although the cleanerless system has the same effects (no waste toner and environment-friendly) as recycling in the cleaning system having a blade, the execution of the mode for discharging a toner adhering to the magnetic brush affects productivity (print volume).

SUMMARY OF THE INVENTION

The invention has been devised in order to solve the problems described above and it is an object of the invention to provide a technique that can realize recycling of a developing agent without deteriorating productivity in a charging device capable of switching and executing charging processing for a photosensitive surface of a photosensitive member and collection processing for a developing agent remaining on the photosensitive surface.

In order to solve the problems, a charging device according to an aspect of the invention is a charging device switching and executing a first mode which brings a magnetic brush including magnetic particles into contact with a photosensitive member to charge a surface of the photosensitive member and a second mode which collects, using the magnetic brush, a two-component developing agent including a toner and a carrier, which remains on the surface of the photosensitive member, the charging device characterized by including: a magnetic brush carrying roller that carries the magnetic brush into contact with the photosensitive member; a toner collecting roller that electrically collects the toner included in the two-component developing agent collected on the magnetic brush according to the execution of the second mode; and a toner removing member that removes the toner collected by the toner collecting roller from a surface of the toner collecting roller.

In order to solve the problems, an image forming apparatus according to another aspect of the invention is characterized by including: a charging device having the structure described above; an exposing unit that forms a desired electrostatic latent image on a photosensitive surface charged by the charging device; a developing device that visualizes, using the two-component developing agent, the electrostatic latent image formed on the photosensitive surface by the exposing unit; and a carrying unit that carries the toner collected by the toner collecting roller to the developing device.

In order to solve the problems, a charging device according to still another aspect of the invention is a charging device switching and executing a first mode which brings a magnetic brush including magnetic particles into contact with a photosensitive member to charge a surface of the photosensitive member and a second mode which collects, using the magnetic brush, a two-component developing agent including a toner and a carrier, which remains on the surface of the photosensitive member, the charging device characterized by including: magnetic brush carrying means for carrying the magnetic brush into contact with the photosensitive member; toner collecting means for electrically collecting the toner included in the two-component developing agent collected on the magnetic brush according to the execution of the second mode; and toner removing means for removing the toner collected by the toner collecting means from the toner collecting means.

DESCRIPTION OF THE EMBODIMENTS

An embodiment of the invention will be hereinafter explained with reference to the drawings.

Figure 1:
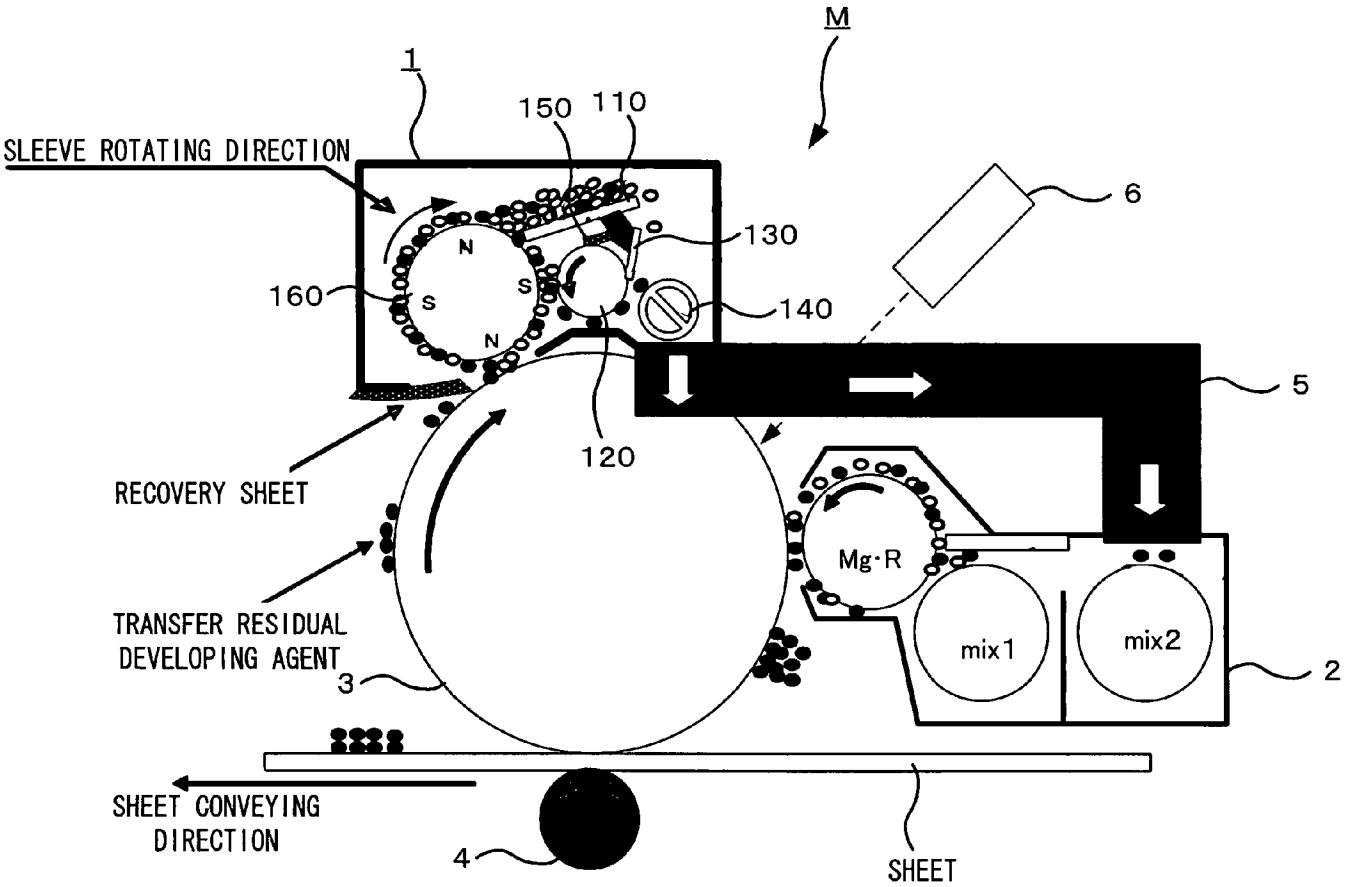
FIG. 1 is a schematic sectional view for explaining an overall structure of a charging device 1 and an image forming apparatus M including the same according to an embodiment of the invention.

FIG. 1 is a schematic sectional view for explaining an overall structure of a charging device 1 and an image forming apparatus M including the same according to an embodiment of the invention. In the figure, a circulating route of recycling processing for a developing agent in the image forming apparatus M is shown.

The image forming apparatus M according to this embodiment includes the charging device 1, a developing device 2, a photosensitive member 3, a transfer roller 4, a conveying unit 5, and an exposing unit 6.

The charging device 1 is capable of switching and executing a first mode for bringing a magnetic brush including magnetic particles into contact with the photosensitive member 3 to charge the surface of the photosensitive member 3 and a second mode for collecting, using the magnetic brush, a two-component developing agent including a toner remaining on a photosensitive surface of the photosensitive member 3 (a residual toner on the photosensitive member not transferred onto a sheet) and a carrier (a transfer residual toner collected by the magnetic brush will be hereinafter represented as collected toner).

The exposing unit 6 forms a desired electrostatic latent image on the photosensitive surface of the photosensitive member 3 charged by the charging device 1.

The developing device 2 visualizes, using a two-component developing agent (a magnetic powder carrier and a dry toner), the electrostatic latent image formed on the photosensitive surface by the exposing unit 6.

Specifically, the charging device 1 includes a magnetic brush carrying roller (magnetic brush carrying means) 160, a toner collecting roller (toner collecting means) 120, a toner removing member (toner removing means) 130, a regulating member (regulating means) 110, a collected toner carrying auger 140, and a potential imparting unit (potential imparting means) 150.

The magnetic brush carrying roller 160 carries the magnetic brush to be capable of coming into contact with the photosensitive member.

The regulating member 110 regulates height of bristles of the magnetic brush carried on the magnetic brush carrying roller 160 to be equal to or smaller than a predetermined height.

The toner collecting roller 120 electrically collects the toner included in the two-component developer collected on the magnetic brush according to the execution of the second mode. The toner collecting roller 120 is located further on a downstream side than the regulating member 110 and further on an upstream side than a contact position of the magnetic brush and the photosensitive member 3 in a moving direction of a roller surface (a carrying surface) of the magnetic brush carrying roller 160 in order to perform stable toner collection processing and prevent transfer of the developing agent to the photosensitive member 3. In other words, it is preferable that the toner collecting roller 120 is arranged in a position closer to the developing device 2 than the magnetic brush carrying roller 160. It is possible to efficiently return the toner collected by the toner collecting roller 120 to the developing device 2 by arranging the toner collecting roller 120 in this way. A resistance of a roller surface (a collecting surface) of the toner collecting roller 120 is set to a resistance for preventing an amount of electric current imparted from the charging device 1 to the photosensitive member 3 from being reduced to be equal to or smaller than a predetermined value.

The toner removing member 130 removes the toner collected by the toner collecting roller 120 from the surface of the toner collecting roller 120.

The potential imparting unit 150 imparts a predetermined potential to the roller surface of the toner collecting roller 120. The toner collecting roller 120 electrically collects, on the basis of the potential imparted by the potential imparting unit 150, the toner included in the two-component developing agent collected on the magnetic brush. When a certain degree of resistance is set on a roller surface of a toner collecting roller, if a desired potential is imparted to the roller surface of the toner collecting roller from the inside of the toner collecting roller, it is necessary to set a resistance of the toner collecting roller 120 low. Thus, a charging current applied to the magnetic brush carrying roller 160 tends to leak. On the other hand, as in this embodiment, if the potential imparting unit 150 consisting of, for example, a conductive sheet member is brought into contact with a roller surface of a toner collecting roller to directly impart a potential to the roller surface, it is easy to impart a desired potential to the surface of the toner collecting roller 120. Thus, it is possible to control a leak of a charging current applied to the magnetic brush carrying roller 160.

In other words, when a potential is imparted to the toner collecting roller 120, which electrically has a resistance (is not insulative), from the inside thereof (e.g., from a conductive shaft), in order to set a potential on the surface of the toner collecting roller 120 to a desired potential, a higher voltage has to be applied to a power supplying unit (the conductive shaft). Concerning the toner collecting roller 120 having a high resistance to prevent a charging current applied to the magnetic brush carrying roller 160 from leaking, there is an advantage that it is easier to manage setting of a potential while preventing a leak current by directly imparting a potential to the surface of the toner collecting roller 120 (using the conductive sheet 150).

In the charging device 1 according to this embodiment, the roller surface of the magnetic brush carrying roller 160 and the roller surface of the toner collecting roller 120 are constituted to move in the same direction in positions close to each other. Since the roller surface of the magnetic brush carrying roller and the roller surface of the toner collecting roller are moved in a so-called "with direction" in positions opposed to each other in this way, bristles of the magnetic brush carried on the magnetic brush carrying roller are not disarranged. The magnetic brush on the magnetic brush carrying roller can stably come into contact with the surface of the photosensitive member after passing the toner collecting roller and contribute to stabilization of charging processing.

Figure 2:
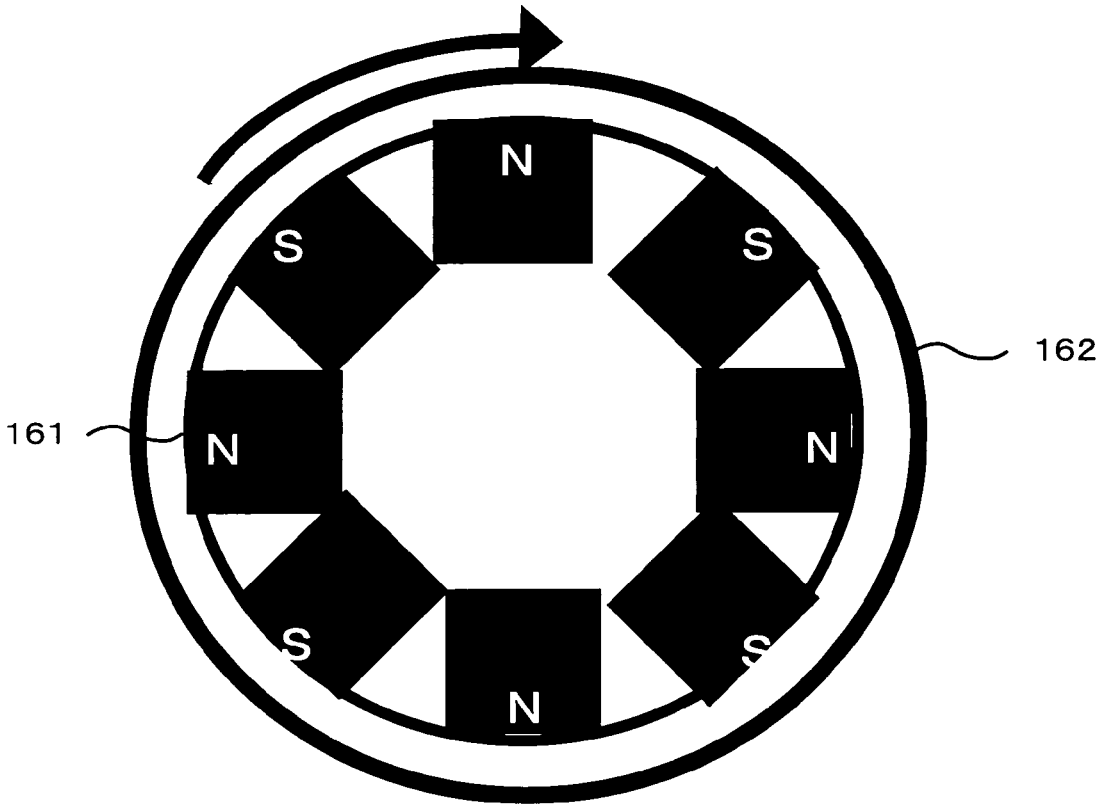
FIG. 2 is a diagram showing details of a structure of a magnetic brush carrying roller 160 according to the embodiment.

FIG. 2 is a diagram showing details of a structure of the magnetic brush carrying roller 160 according to this embodiment. As shown in the figure, the magnetic brush carrying roller 160 according to this embodiment includes a magnet roller 161 having plural fixed magnetic poles (e.g., eight poles) and a cylindrical sleeve 162 rotatably provided on the outer periphery of the magnet roller 161. Relative rotating directions of the magnet roller 161 and the sleeve 162 are opposite.

Since the relative rotating directions of the magnet roller 161 and the sleeve 162 are set to be opposite, raising and lowering of the bristles of the magnetic brush carried on the outer peripheral surface of the sleeve 162 are repeated. Consequently, the magnetic powder carrier and the collected toner rub against each other on the sleeve 162 to make it possible to quicken triboelectric charging of the collected toner. By including magnetic powder in a toner to be used, with the addition of an effect of injection charging, it is possible to further quicken charge impartation to the toner.

When the magnet roller 161 is stationarily arranged with respect to the charging device 1 as shown in FIG. 2, it is preferable that any one of the plural fixed magnetic poles of the magnet roller 161 is arranged near a position where the roller surface of the magnetic brush carrying roller 160 and the roller surface of the toner collecting roller 120 are close to each other. This makes it possible to increase the height of the bristles of the magnetic brush near a position where the magnetic brush carrying roller and the toner collecting roller are close to each other and contribute to stable toner collection in the toner collecting roller.

Figure 3:
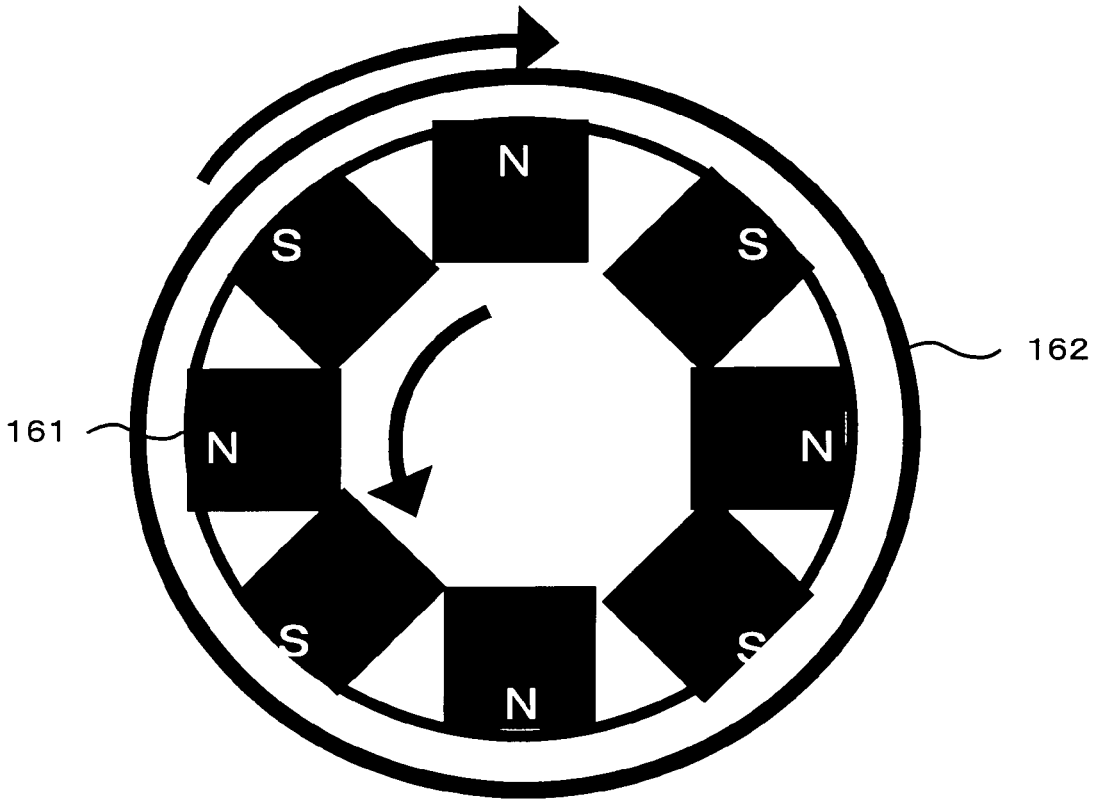
FIG. 3 is a diagram showing details of another structure of the magnetic brush carrying roller 160 according to the embodiment.

In an example shown in FIG. 2, the magnet roller 161 is stationarily arranged (not to rotate) and the sleeve 162 rotates clockwise around the magnet roller 161. However, the invention is not limited to this. For example, as shown in FIG. 3, it is also possible that the magnet roller 161 rotates counterclockwise and the sleeve 162 rotates clockwise. When the magnet roller 161 is stationarily arranged, immediately after a transfer residual toner is deposited on the magnetic brush from the surface of the photosensitive member, since triboelectric charging between the toner and the carrier is not sufficiently performed, electric deposition of the toner on the toner collection roller cannot be efficiently performed in some cases. On the other hand, when the magnet roller 161 and the sleeve 162 rotate in opposite directions, since a magnetic force on the sleeve suddenly fluctuates, the carrier intensely swings. Immediately after the transfer residual toner adheres to the magnetic brush from the surface of the photosensitive member, triboelectric charging between the toner and the carrier is performed in a short time. The electric deposition of the collected toner on the toner collecting roller can be efficiently performed in this way. This makes it possible to arrange the toner collecting roller 120 further on a downstream side than the contact position of the magnetic brush and the photosensitive member 3 and further on an upstream side than the regulating member 110 in the moving direction of the roller surface of the magnetic brush carrying roller 160.

The conveying unit 5 carries the toner collected by the toner collecting roller 120 to the developing device 2. Consequently, even when a large quantity of toner is collected on the charging device side as in, for example, printing of an image with an extremely high printing ratio, it is possible to directly return the toner collected on the charging device side to the developing device without returning the toner to the photosensitive member. This is preferable from a viewpoint of efficiency of recycling of a developing agent and from a view point of efficiency of image formation processing.

In a state in which the carrier easily adheres to the photosensitive member from the developing device 2 such as a low-temperature and low-humidity environment, even when the carrier is supplied to the magnetic brush carrying roller 160, the conveying unit 5 carries a mixture of the carrier and the toner (hereinafter represented as developing agent), which are regulated by the regulating member 110 and accumulated on the regulating member 110, to the developing device 2 even if the mixture falls from the regulating member 110. In this way, even the developing agent scraped from the tip portion of the magnetic brush by the regulating member 110 is returned to the developing device 2 by the conveying unit 5. This makes it possible to reuse the developing agent without wastefully discarding the developing agent.

In the image forming apparatus M according to this embodiment, at least core materials of the magnetic particles included in the magnetic brush carried by the magnetic brush carrying roller 160 and the carrier included in the two-component developing agent are made of an identical material. Since the carrier of the two-component developing agent used in the developing device 2 and the magnetic particles of the magnetic brush in the charging device 1 are made of the same core material in this way, it is possible to compensate for a reduction of the magnetic particles in the charging device 1 due to use for a long period of time.

Details of structures of the charging device 1 and the image forming apparatus M according to this embodiment and operations of the same will be hereinafter explained.

The sleeve 162 (FIG. 2) of the magnetic brush carrying roller 160 rotates in a direction away from the surface of the photosensitive member 3 (moves in an opposite direction in the position where the roller surfaces are close to each other). After the thickness of the developing agent is regulated by the regulating member 110, the magnetic brush comes into contact with the photosensitive member 3 and the toner collecting roller 120 to perform nonpatternization of the transfer residual toner and deposition of the carrier on the magnetic brush.

The toner collecting roller 120 comes into contact with the magnetic brush, separates the collected toner from the carrier, and causes the collected toner to adhere to the surface of the toner collecting roller 120 in a state in which charges on the surface are eliminated by the potential imparting unit 150 consisting of the grounded conductive sheet. Alternatively, the toner collecting roller 120 may come into contact with the magnetic brush, separate the collected toner from the carrier, and cause the collected toner to adhere to the surface of the toner collecting roller 120 in a state in which a potential of a polarity opposite to that of the magnetic brush carrying roller 160 is imparted to the potential imparting unit 150 to adjust a potential of the surface. However, although a transfer ratio of the toner to the toner collecting roller 120 increases as a toner specific concentration in the magnetic brush is higher, the magnetic powder carrier in the magnetic brush adheres to the photosensitive member 3 when a toner specific concentration in the magnetic brush is extremely low. Thus, it is advisable to hold down a difference between a surface layer potential of the toner collecting roller 120 after coming into contact with the potential imparting unit 150 and an applied voltage to the magnetic brush carrying roller 160. In this embodiment, a surface potential of the toner collecting roller 120 is set to about −150 V with respect to an applied voltage of −400 V to the magnetic brush.

When an electric resistance of the toner collecting roller 120 in contact with the magnetic brush is low, a leak of a charging current occurs. Thus, a material having an electric resistance equal to or higher than a surface layer resistance of $1\times10^{9}$ Ωm is used. The collected toner adhering to the toner collecting roller 120 is separated by the toner removing member 130 made of a PET (polyethylene terephthalate) material or the like. In this embodiment, a toner removing member obtained by wrapping a belt-like sheet with a surface layer resistance of $1.8\times10^{10}$ Ωm and thickness of 10 μm around an insulative roller is used.

The collected toner separated from the toner collecting roller 120 by the toner removing member 130 is returned to the developing device 2 by the collected toner carrying auger 140 and the conveying unit 5 (the collected toner carrying auger 140 and the conveying unit 5 correspond to the carrying unit). The collected toner is mixed with the carrier in the developing device 2 and used for image formation processing again. A phenomenon of adhesion of the carrier from the developing device 2 to the photosensitive member 3 is well known. However, the carrier may adhere to the photosensitive member 3 from the charging device 1. When the magnetic powder carrier used in the developing device 2 is forcibly caused to adhere to the surface of the photosensitive member 3 according to potential control and supplied to the magnetic brush carrying roller 160, even if an amount of the magnetic powder carrier is too large, the magnetic powder carrier returns to the collected toner carrying auger 140 through the regulating member 110. In a setting in FIG. 1, when magnetic powder blocked by the regulating member 110 exceeds a fixed amount, the magnetic powder overflows to the collected toner carrying auger 140.

In the embodiment, the toner removing member 130 is arranged to incline further to the downstream side in the rotating direction of the toner collecting roller than a rotation radius direction of the toner collecting roller. In the embodiment, by arranging the toner removing member 130 in this way, the toner collected by the toner collecting roller 120 is scraped off to the collected toner carrying auger 140.

A method of arranging the toner removing member 130 is not limited to the method described above. For example, the toner removing member 130 may be arranged to incline further to the upstream side in the rotating direction of the toner collection roller than the rotation radius direction of the toner collection roller. In this case, the toner scraped from the toner collecting roller 120 by the toner removing member 130 deposits on the toner removing member 130 and falls toward the collected toner carrying auger 140 from an end on a side not close to the toner collecting roller 120 of the toner removing member 130.

As described above, according to this embodiment, it is possible to provide a toner recycling method in a charging device capable of switching and executing a first mode for bringing a magnetic brush including magnetic particles into contact with a photosensitive member to charge a surface of the photosensitive member and a second mode for collecting, using the magnetic brush, a two-component developing agent including a toner and a carrier, which remains on the surface of the photosensitive member. In the developing agent recycling method, the toner included in the two-component developing agent collected on the magnetic brush according to the execution of the second mode is electrically collected and the toner collected by a toner collecting roller is removed from the surface of the toner collecting roller.

According to this embodiment, it is possible to remove the toner out of the two-component developing agent collected by the magnetic brush of the charging device in a large quantity of continuous printing, high printing ratio printing, or the like without suspending charging processing applied to the photosensitive member. This makes it possible to improve productivity of print output while suppressing irregularity of image qualities.

According to the constitution described above, in the charging device that performs charging processing for the surface of the photosensitive member, it is possible to perform cleaning of a transfer residual developing agent on the surface of the photosensitive member without deteriorating productivity. Since the toner included in the transfer residual developing agent collected from the surface of the photosensitive member in this way is selectively collected, the carrier with a low toner ratio compared with a mixing ratio of the carrier and the toner controlled by the developing device 2 remains on the magnetic brush carrying roller. It is possible to reuse the carrier as magnetic particles forming the magnetic brush. It goes without saying that the toner collected by the toner collecting roller is also reusable in, for example, the developing device. It is possible to effectively reuse the transfer residual developing agent collected from the surface of the photosensitive member.

The invention has been explained in detail with reference to the specific forms. However, it would be apparent for those skilled in the art that various alterations and modification can be made without departing from the spirit and the scope of the invention.

As described above in detail, according to the invention, it is possible to provide a technique that can realize recycling of a developing agent without deteriorating productivity in a charging device capable of switching and executing charging processing for a photosensitive surface of a photosensitive member and collection processing for a developing agent remaining on the photosensitive surface.

What is claimed is:

1. A charging device switching and executing a first mode which brings a magnetic brush including magnetic particles into contact with a photosensitive member to charge a surface of the photosensitive member and a second mode which collects, using the magnetic brush, a two-component developing agent including a toner and a carrier, which remains on the surface of the photosensitive member, the charging device comprising:

a magnetic brush carrying roller configured to carry the magnetic brush into contact with the photosensitive member;

a toner collecting roller configured to electrically collect the toner included in the two-component developing agent collected on the magnetic brush according to the execution of the second mode;

a toner removing member configured to remove the toner collected by the toner collecting roller from a surface of the toner collecting roller;

a regulating member configured to regulate height of bristles of the magnetic brush carried on the magnetic brush carrying roller to be equal to or smaller than a predetermined height; and a carrying unit configured to carry a toner falling from the regulating member in a developing agent regulated by the regulating member and accumulated on the regulating member to a developing device, wherein the toner collecting roller is located further on a downstream side than the regulating member and further on an upstream side than a contact position of the magnetic brush and the photosensitive member in a moving direction of a roller surface of the magnetic brush carrying roller.

2. A charging device according to claim 1, wherein a roller surface of the magnetic brush carrying roller and a roller surface of the toner collecting roller move in a same direction in positions close to each other.

3. A charging device according to claim 1, wherein the magnetic brush carrying roller includes a magnet roller having plural fixed magnetic poles and a sleeve rotatably provided on an outer periphery of the magnet roller, and relative rotating directions of the magnet roller and the sleeve are opposite, or the magnet roller is stationarily arranged with respect to the charging device and the sleeve rotates around the magnet roller.

4. A charging device according to claim 3, wherein the magnet roller is stationarily arranged with respect to the charging device, and any one of the plural fixed magnetic poles of the magnet roller is arranged near a position where the roller surface of the magnetic brush carrying roller and a roller surface of the toner collecting roller are close to each other.

5. A charging device according to claim 3, further comprising a regulating member configured to regulate height of bristles of the magnetic brush carried on the magnetic brush carrying roller to be equal to or smaller than a predetermined height, wherein the toner collecting roller is located further on a downstream side than a contact position of the magnetic brush and the photosensitive member and further on an upstream side than the regulating member in a moving direction of a roller surface of the magnetic brush carrying roller.

6. A charging device switching and executing a first mode which brings a magnetic brush including magnetic particles into contact with a photosensitive member to charge a surface of the photosensitive member and a second mode which collects, using the magnetic brush, a two-component developing agent including a toner and a carrier, which remains on the surface of the photosensitive member, the charging device comprising:

a magnetic brush carrying roller configured to carry the magnetic brush into contact with the photosensitive member;

a toner collecting roller configured to electrically collect the toner included in the two-component developing agent collected on the magnetic brush according to the execution of the second mode; and a toner removing member configured to remove the toner collected by the toner collecting roller from a surface of the toner collecting roller, wherein a resistance of a roller surface of the toner collecting roller is set to a resistance for preventing an amount of electric current imparted from the charging device to the photosensitive member from being reduced to be equal to or smaller than a predetermined value.

7. A charging device according to claim 6, further comprising a potential imparting unit configured to impart a predetermined potential to the roller surface of the toner collecting roller, wherein the toner collecting roller electrically collects, on the basis of the potential imparted by the potential imparting unit, the toner included in the two-component developing agent collected on the magnetic brush.

8. An image forming apparatus comprising:

a charging device according to claim 1;

an exposing unit configured to form a desired electrostatic latent image on a photosensitive surface charged by the charging device;

a developing device configured to visualize, using the two-component developing agent, the electrostatic latent image formed on the photosensitive surface by the exposing unit; and a carrying unit configured to carry the toner collected by the toner collecting roller to the developing device.

9. An image forming apparatus according to claim 8, wherein the toner collecting roller is arranged in a position closer to the developing device than the magnetic brush carrying roller.

10. An image forming apparatus according to claim 8, wherein at least core materials of magnetic particles included in a magnetic brush carried by the magnetic brush carrying roller and a carrier included in the two-component developing agent are an identical material.

11. A charging device switching and executing a first mode which brings a magnetic brush including magnetic particles into contact with a photosensitive member to charge a surface of the photosensitive member and a second mode which collects, using the magnetic brush, a two-component developing agent including a toner and a carrier, which remains on the surface of the photosensitive member, the charging device comprising:

magnetic brush carrying means for carrying the magnetic brush into contact with the photosensitive member;

toner collecting means for electrically collecting the toner included in the two-component developing agent collected on the magnetic brush according to the execution of the second mode;

toner removing means for removing the toner collected by the toner collecting means from the toner collecting means;

regulating means for regulating height of bristles of the magnetic brush carried on the magnetic brush carrying means to be equal to or smaller than a predetermined height; and carrying means for carrying a toner falling from the regulating member in a developing agent regulated by the regulating means and accumulated on the regulating means to a developing device, wherein the toner collecting means is located further on a downstream side than the regulating means and further on an upstream side than a contact position of the magnetic brush and the photosensitive member in a moving direction of a carrying surface of the magnetic brush carrying means.

12. A charging device according to claim 11, wherein a carrying surface of the magnetic brush carrying means and a collecting surface of the toner collecting means move in a same direction in positions close to each other.

13. A charging device according to claim 11, wherein the magnetic brush carrying means includes a magnet roller having plural fixed magnetic poles and a sleeve rotatably provided on an outer periphery of the magnet roller, and relative rotating directions of the magnet roller and the sleeve are opposite, or the magnet roller is stationarily arranged with respect to the charging device and the sleeve rotates around the magnet roller.

14. A charging device according to claim 13, wherein the magnet roller is stationarily arranged with respect to the charging device, and any one of the plural fixed magnetic poles of the magnet roller is arranged near a position where a carrying surface of the magnetic brush carrying means and a collecting surface of the toner collecting means are close to each other.

15. A charging device according to claim 13, further comprising regulating means for regulating height of bristles of the magnetic brush carried on the magnetic brush carrying means to be equal to or smaller than a predetermined height, wherein the toner collecting means is located further on a downstream side than a contact position of the magnetic brush and the photosensitive member and further on an upstream side than the regulating means in a moving direction of a carrying surface of the magnetic brush carrying means.

16. A charging device switching and executing a first mode which brings a magnetic brush including magnetic particles into contact with a photosensitive member to charge a surface of the photosensitive member and a second mode which collects, using the magnetic brush, a two-component developing agent including a toner and a carrier, which remains on the surface of the photosensitive member, the charging device comprising:

magnetic brush carrying means for carrying the magnetic brush into contact with the photosensitive member;

toner collecting means for electrically collecting the toner included in the two-component developing agent collected on the magnetic brush according to the execution of the second mode; and toner removing means for removing the toner collected by the toner collecting means from the toner collecting means, wherein a resistance of a collecting surface of the toner collecting means is set to a resistance for preventing an amount of electric current imparted from the charging device to the photosensitive member from being reduced to be equal to or smaller than a predetermined value.

17. A charging device according to claim 16, further comprising potential imparting means for imparting a predetermined potential to the collecting surface of the toner collecting means, wherein the toner collecting means electrically collects, on the basis of the potential imparted by the potential imparting means, the toner included in the two-component developing agent collected on the magnetic brush.

* * * * *